US010911855B2

(12) United States Patent
Tiscareno

(10) Patent No.: US 10,911,855 B2
(45) Date of Patent: Feb. 2, 2021

(54) HEADPHONE ACOUSTIC TRANSFORMER

(71) Applicant: VZR, INC., Issaquah, WA (US)

(72) Inventor: Victor Manuel Tiscareno, Issaquah, WA (US)

(73) Assignee: VZR, Inc., Issaquah, WA (US)

( * ) Notice: Subject to any disclaimer, the term of this patent is extended or adjusted under 35 U.S.C. 154(b) by 0 days.

(21) Appl. No.: 16/351,504

(22) Filed: Mar. 12, 2019

(65) Prior Publication Data

US 2020/0154189 A1 May 14, 2020

Related U.S. Application Data

(60) Provisional application No. 62/758,448, filed on Nov. 9, 2018.

(51) Int. Cl.

| | |
|---|---|
| ***H04R 1/10*** | (2006.01) |
| ***H04R 1/22*** | (2006.01) |
| ***H04R 9/06*** | (2006.01) |

(52) U.S. Cl.

CPC ..... *H04R 1/1008* (2013.01); *H04R 1/1066* (2013.01); *H04R 1/22* (2013.01); *H04R 9/063* (2013.01); *H04R 1/1016* (2013.01)

(58) Field of Classification Search

CPC .. H04R 1/1008; H04R 1/1058; H04R 1/1066; H04R 1/22; H04R 5/033; H04R 9/063

USPC ..... 381/370–373, 74, 391, 395; 181/182, 181/183, 184; 455/575.2

See application file for complete search history.

(56) References Cited

U.S. PATENT DOCUMENTS 4,211,898 A * 7/1980 Atoji ..... H04R 1/225 381/349
4,718,517 A * 1/1988 Carlson ..... H04R 1/345 181/159
4,922,542 A * 5/1990 Sapiejewski ..... G10K 11/178 381/373
4,924,502 A * 5/1990 Allen ..... A42B 3/166 181/129
5,033,086 A 7/1991 Fidi (Continued)

FOREIGN PATENT DOCUMENTS

WO 2004091252 A1 10/2004

OTHER PUBLICATIONS

"Head-Related Transfer Function", Wikipedia, Nov. 17, 2017, https://web.archive.org/web/20171216035821/https://en.wikipedia.org/wiki/Head-related_transfer_function.

(Continued)

*Primary Examiner* — Xu Mei
(74) *Attorney, Agent, or Firm* — Han Santos, PLLC

(57) ABSTRACT

An acoustic transformer for use in a headphone to enhance an auditory experience of a listener, includes a disc or plate with acoustic apertures or aperture regions that is located in front of an acoustic driver in an ear cup of the headphone. In an example configuration, one side or area of the acoustic transformer includes multiple, smaller apertures and an opposite side or area of the acoustic transformer includes a lesser number of larger apertures, or a single larger aperture. When the headphone is over the listener's ear the acoustic transformer is juxtaposed between the acoustic driver and the listener, and in an example configuration the smaller apertures are located toward the front of the listener's ear, and the larger aperture is located toward the back of the listener's ear.

20 Claims, 9 Drawing Sheets

(56) References Cited

U.S. PATENT DOCUMENTS

| | | | | |
|---|---|---|---|---|
| 5,729,605 | A | 3/1998 | Babisuthi et al. | |
| 5,844,998 | A * | 12/1998 | Nageno | H04R 1/2842 381/371 |
| RE37,398 | E | 10/2001 | Nageno | |
| 6,320,970 | B1 | 11/2001 | Czerwinski | |
| 6,438,227 | B1 | 8/2002 | Kretsch | |
| 6,611,603 | B1 | 8/2003 | Norris et al. | |
| 6,817,440 | B1 | 11/2004 | Kim | |
| 6,934,401 | B2 | 8/2005 | Grell et al. | |
| 7,162,051 | B2 | 1/2007 | Grell et al. | |
| 7,165,647 | B2 * | 1/2007 | Lee | H04R 19/04 181/158 |
| 7,167,567 | B1 | 1/2007 | Sibbald et al. | |
| 7,316,290 | B2 | 1/2008 | Hutt et al. | |
| 7,340,071 | B2 | 3/2008 | Huang | |
| 7,510,049 | B2 * | 3/2009 | Kling | G10K 11/26 181/185 |
| 8,000,486 | B2 | 8/2011 | Hildebrandt | |
| 8,045,718 | B2 | 10/2011 | Faure et al. | |
| 8,447,058 | B1 | 5/2013 | Sung et al. | |
| 8,718,312 | B2 * | 5/2014 | Lin | H04R 1/1008 181/129 |
| 8,989,419 | B2 | 3/2015 | Graber et al. | |
| 9,258,664 | B2 | 2/2016 | Kraemer | |
| 9,426,555 | B2 | 8/2016 | Yamamoto | |
| 9,591,406 | B1 | 3/2017 | Huang | |
| 9,743,174 | B2 | 8/2017 | Oclee-Brown et al. | |
| 9,794,682 | B2 | 10/2017 | Honda et al. | |
| 9,848,271 | B2 | 12/2017 | Lyren et al. | |
| 9,854,352 | B2 | 12/2017 | Huang | |
| 9,866,963 | B2 | 1/2018 | Kraemer | |
| 9,918,177 | B2 | 3/2018 | Horbach | |
| 9,918,178 | B2 | 3/2018 | Norris et al. | |
| 9,936,281 | B2 | 4/2018 | Tamura et al. | |
| 2005/0238189 | A1 | 10/2005 | Tsai | |
| 2012/0033842 | A1 * | 2/2012 | Donarski | G10K 11/025 381/340 |
| 2013/0142376 | A1 * | 6/2013 | Lin | H04R 1/1008 381/373 |
| 2013/0188801 | A1 * | 7/2013 | Ambrose | H04R 1/1016 381/71.6 |
| 2015/0172805 | A1 | 6/2015 | Oishi et al. | |
| 2015/0208160 | A1 * | 7/2015 | Chu | H04R 1/1058 381/373 |
| 2015/0249878 | A1 | 9/2015 | Wen | |
| 2018/0310090 | A1 | 10/2018 | Wen et al. | |

OTHER PUBLICATIONS

"Natural Sound Rendering for Headphones: Integration of Signal Processing Techniques", Sunder et al., IEEE Signal Processing Magazine Special Issue on Sound Processing Techniques for Assisted Listening, vol. 32, No. 2, pp. 100-113, Mar. 2015.

Sean Olive et al., "Perception & Measurement of Headphone Sound Quality: Is There a Preferred Target Response?", Harman International Industries Incorporated, Oct. 16, 2017, pp. 1-65.

George L. Augspurger, "The Acoustical Lens", Electronics World, Dec. 1962.

Sean Olive et al., "Perception & Measurement of Headphone Sound Quality: Is There a Preferred Target Response?", Harman International Industries Incorporated, Oct. 16, 2017, pp. 66-132.

International Application No. PCT/US2019/060138, International Search Report and Written Opinion dated Jan. 22, 2020, 15 pages.

* cited by examiner

HEADPHONE ACOUSTIC TRANSFORMER

BACKGROUND

In the field of sound reproduction and particularly in the field of headsets that provide a cup around a listener's ear with a speaker or driver in the cup to generate sound and deliver it to the listener's ear, reproducing sound in such a way that the listener perceives the sound as the same or similar as if the listener were hearing it in an open-air setting without wearing headphones can be challenging. In addition, generating or reproducing sound in a headset that gives the listener an experience of the sound coming from a particular direction (and moving relative to the listener) can also be challenging.

BRIEF DESCRIPTION OF THE DRAWINGS

The left-most digit(s) of a reference number identifies the figure in which the reference number first appears, and same reference numbers indicate similar or identical items.

DETAILED DESCRIPTION

Figure 1:
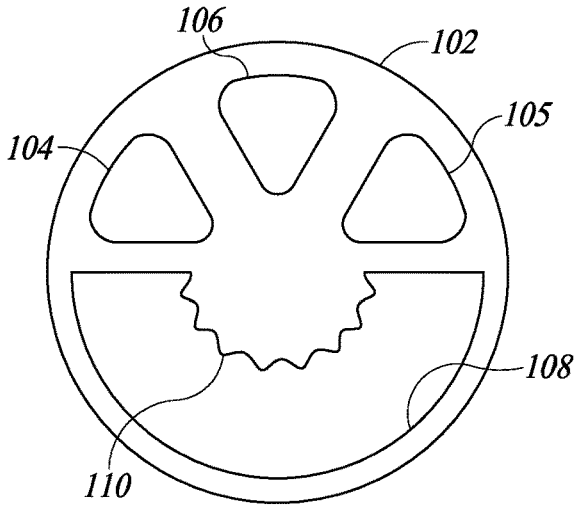
FIG. 1 shows a first exemplary acoustic transformer.

Sound is one of the most important senses people use in daily life, along with sight, touch, smell, and so forth. We can hear sound from different directions including sound emanating from behind and/or above us, and can often discern direction and distance to sound sources, as well as relative speed or velocity between us and those sound sources (from change in volume or intensity, change in frequency or tone such as Doppler shift, and so forth). As consumer electronics (hardware and software) become increasingly sophisticated, there is increasing demand for a natural sound experience from digital media sources of all types, including real-time electronic communications such as telephone and teleconference calls, movies, games, music, augmented reality scenarios and so forth. In this context, emitting "natural" sound from electronic and electromechanical devices includes recreating sound to provide the listener with an immersive experience, that accurately, authentically or convincingly simulates a particular acoustic environment and/or event for the listener. This can be done, for example, with the use of specialized recording methods or digital signal processing that capture or encode three-dimensional audio cues and acoustic characteristics that provide the listener with spatial information such as direction and/or location of sound sources relative to the listener, including information about an environment surrounding the sound sources and the listener (reflective, absorbent, enclosed, and so forth). One challenge in providing this kind of aural experience is that playback devices such as headphones are used, and a combined transfer function of the headphones and the listener's ear structure is different than a combined transfer function of open air and the listener's ear structure, between a sound source and the listener's inner ear.

The listening experience can be thought of as having at least three major components—a source, a transmission medium, and a listener. In a natural system the sound source can be, for example, a loudspeaker at a concert, a helicopter, a thunderstorm, a person playing a piano or a guitar, a person speaking, a rifle, a tree in the wind, and so forth. The transmission medium can for example be an open-air natural environment, a room or cave with a sound source in it, a tunnel, a forest, a mountain valley with rock faces nearby (that reflect echos, for example), and so forth. Aspects of the listener can affect the listening experience—sound can for example encounter the person (clothing, hair, face, and so forth), and may be channeled in different ways by the listener's ear structure (outer ear, inner ear, and so forth) between the listener's eardrum and the transmission medium. Bone conduction, or transmission of sound through parts of the listener's body other than the ear to the eardrum, can influence the listener's natural listening experience. Principles of diffraction, refraction, interference, reflection, and so forth can influence sound traveling between the sound source and the listener's eardrum(s), for example depending on what the transmission medium or environment is composed of, and how different elements in it are arranged. Aspects of the listener can be considered either part of the transmission medium (e.g., clothing, body structure including pinnae or outer ears, etc.) or can be considered part of the listener, but in principle are part of an overall transfer function or effect between the source and the ultimate receiver, whether the ultimate receiver is defined as the listener's brain, cochlea, eardrum, inner ear, or outer ear, or entire person.

Where sound is reproduced for a listener via headphones, the resulting system is basically an electronic signal provided to the headphones, which then generates sound in the ear piece(s) or ear cup(s) and projects it toward the listener's ear(s). The drivers in the headphones will have specific (and likely imperfect, or an imperfect compromise of) performance characteristics, and by their very proximity and creation of a closed environment around the ear, ear pieces or ear cups of the headphones also modify and/or abrogate functions of the listener's ear structure, for example the pinna. Accordingly, generating and transmitting sound from small, enclosed spaces such as within ear cups of headphones fitted over a listener's ears and against the listener's head, that provides the listener with an acoustic experience intended to replicate sound generated in an open air environment with significant directionality (e.g., sensation of a helicopter orbiting around the listener) can be challenging.

Several factors create specific challenges for creating a natural sound experience using headphones. First, in a natural sound experience there are often both directional sound sources, and more diffuse sound elements in the sound source environment. In a case where recordings are processed for playback over loudspeakers, if those recordings are then played back over headphones the listener's audio experience is unnatural, largely on account of lost crosstalk and issues relating to localization. Lost crosstalk refers to absence of sound that reaches the listener by different paths, for example directly from the source, plus indirectly as from echoes, indirectly via conduction of a portion of the sound through bone to the listener's inner ear rather than via the listener's outer ear, sound that reaches one of the listener's ears earlier (or later) than it reaches the listener's other ear, and so forth. Second, since the headphones are on the listener's head and effectively have a small chamber created between the listener's head and the ear cups of the headphones, the open air transfer function and the transfer function of the listener's ear are altered or absent. Accordingly, the headphones need further equalization to at least partially compensate. This equalization can be very difficult. One reason that equalization is difficult is because the listener's outer ear helps the listener discern directionality, and the headphone's local sound source in the ear cup omits or distorts directional information and can also lead to coloration inaccuracies—when the listener's head moves, the headphones move with it and thus movement of the listener's head won't provide directional information (unlike the listener's aural experience in a natural system or natural sound experience). Yet another reason that equalization can be difficult is that not only the listener's outer ear, but also other parts of the listener's body can influence sound waves before they reach the listener's inner ear—for example sound traveling along the listener's clothing, face, via bone-conduction through the listener's jaw and skull, and so forth.

Another challenge with headphones is that reproducing higher frequencies of sound in a headset with sufficient power and balance can be difficult. For example, many headphones have trouble providing linear frequency response, typically above about 8 KHz. This in turn increases a difficulty of providing a realistic, three-dimensional aural experience to the listener, because it is the higher frequencies, for example 6 kHz and above, that provide directional information to the listener.

Example embodiments variously described herein address and resolve or mitigate many of these challenges, and include a physical or solid state transfer function that receives a signal, for example an equivalent of an open air signal, and changes the signal to compensate for a listener's ear function that is omitted or altered by an environment that the headset and the listener's ear structure together create.

In accordance with various embodiments described herein, an acoustic transformer can be in the form of a plate, disc, or other generally fixed element that is provided within a headphone ear cup, between a speaker or driver in the ear cup and a listener's ear when the listener is wearing the headphone. The acoustic transformer effectively acts as a physical transfer function that moderates or corrects negative effects of the headset on a normal transfer function of the listener's outer ear, in other words a transfer function that exists between a natural free-air sound source and the listener's inner ear. The acoustic transformer includes strategically located apertures or acoustic windows (for example, areas with low acoustic impedance) that direct higher frequencies toward the listener's ear canal, and direct lower frequencies toward the back of the listener's ear when the acoustic transformer is oriented with respect to the listener's ear. The acoustic transformer effectively also changes path lengths that sound from the driver would otherwise travel to meet the listener's ear, which also can enhance the listener's listening experience. The pinna of the human ear is asymmetrical, for example along both vertical and horizontal axes. One effect of this is that sounds coming from different directions to a listener's ear are captured differently, including having different path lengths along the pinna to the inner ear, and this can provide directional information regarding the sound source to the listener's brain. An example aspect of this is shown generally in FIG. 16.

Figure 16:
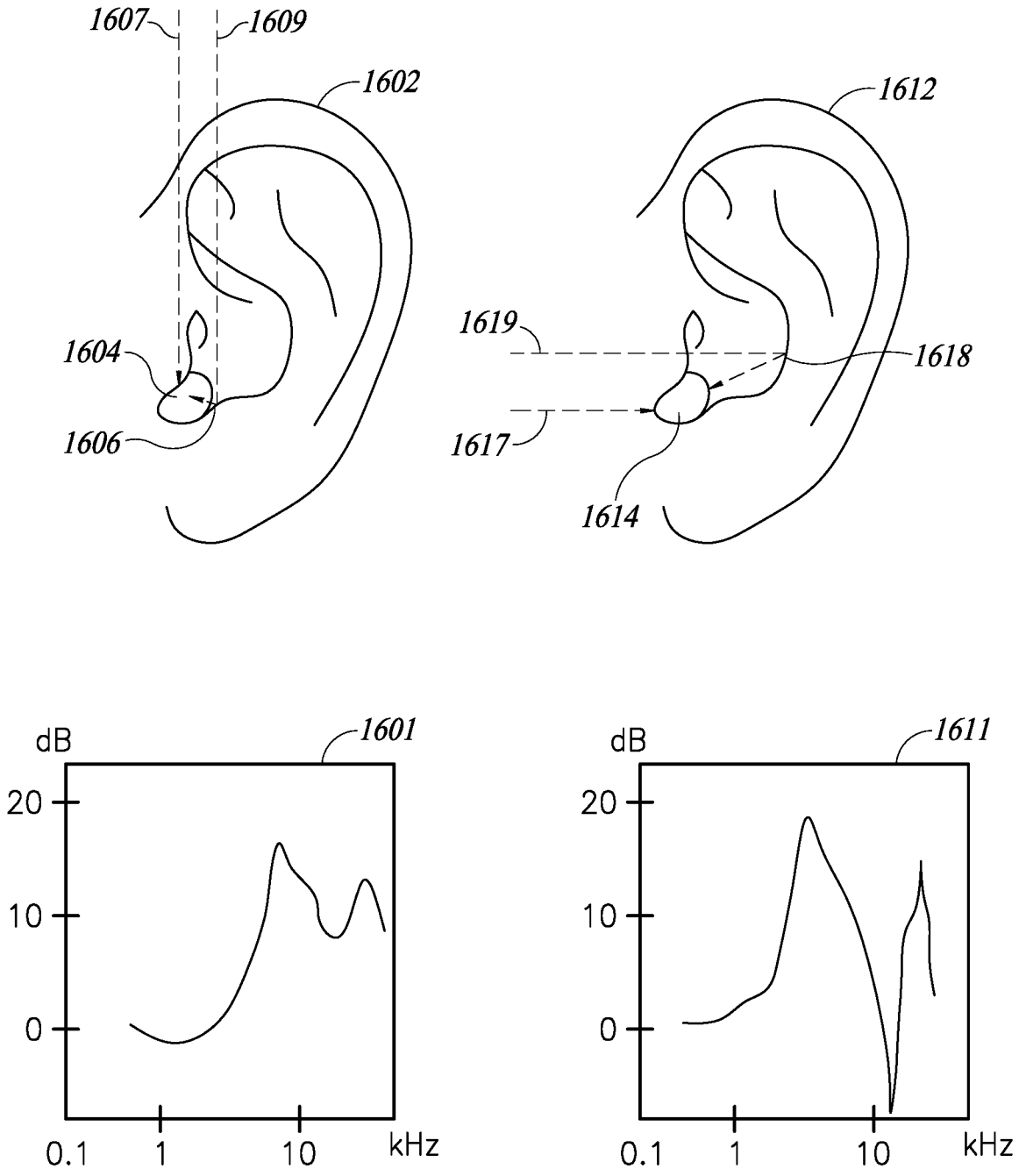
FIG. 16 shows examples of how sound encountering a listener's ear from different angles results in different perceived frequency responses.

As shown in FIG. 16, sound waves 1607, 1609 coming downwards in a vertical direction to encounter a listener's ear 1602 can have different path lengths. The sound waves 1607 travel directly to the ear canal 1604 and the sound waves 1609 travel past the listener's ear canal 1604, then bounce off an inner ridge 1606 of the listener's ear to return and enter the ear canal 1604, having taken a longer path. The graph 1601 shows an example general frequency response of the listener's ear 1602 to sound waves coming from a vertical direction, as for example the sound waves 1607, 1609. FIG. 16 also shows another listener's ear 1612, with sound waves 1619, 1617 coming from a frontal, horizontal direction. As shown, the sound waves 1617 travel directly to the listener's ear canal 1614, while the sound waves 1619 travel past the ear canal 1614 and then bounce off an inner ridge or feature 1618 of the listener's ear to return and enter the ear canal 1614, having taken a longer path. The graph 1611 shows an example general frequency response of the listener's ear 1612 to sound waves coming from the frontal, horizontal direction, as for example the sound waves 1617, 1619. Thus the physical structure of a human listener's ear, including the pinna, produces different hearing frequency responses for the listener depending on the frequencies, and directions or vectors, of sound encountering the listener's ear.

As noted earlier, headphones provide sound to the listener's ear differently than a free-air source does, at least in part because of the near proximity of the headphone acoustic driver to the listener's ear and the enclosed space formed by the headphone cup around the listener's ear. Accordingly, the listener's listening experience with headphones can be very different from a listening experience that a free-air sound source would provide. Embodiments of the acoustic transformer described herein can provide a corrective audio transfer or transformation function between a headphone and a listener's ear that overcomes many of the acoustic changes and distortions that headphones introduce, to mimic a free-air listening experience for the listener and improve the quality of the listener's experience.

In addition, proximity as well as orientation of the acoustic transformer to an outer surface of the driver's acoustic drive surface (also referred to as a driving surface of the driver), for example a speaker cone or diaphragm, can be adjusted or selected to effectively increase power or intensity of the higher frequency sound generated by the driver, thus improving linearity of the driver's response in higher frequencies that provide both a balanced and pleasing aural experience for the listener as well as a realistic three-dimensional (x, y, z) aural experience, for example a realistic perception that a sound source is moving relative to the listener, such as a helicopter flying past or circling overhead. Generally, the impact is realized across the entire audio spectrum, for example within a natural human hearing range. The natural human hearing range can be considered to range from 20 Hz to 20 kHz, although individuals may have hearing ranges that extend beyond one or both of these upper and lower limits. In addition, in some circumstances it can be advantageous to extend capabilities of example embodiments beyond the 20 Hz lower limit and/or the 20 kHz upper limit, for example to fractional or integer multiples of 20 kHz as an upper limit of generated sound, due to harmonics and other phenomena that can affect sound experienced by the listener within the listener's hearing range. When measured, the improvement or audio effect enhancement can be broad, and can for example be noted from 1 kHz (or lower) to at least 12 kHz. This type of experience can be especially valued by video gamers who rely on aural as well as visual information to perform effectively, and by listeners seeking an immersive virtual experience that includes audio or audiovisual stimuli, for example for improved situational awareness and so forth. Accordingly, a proximity or distance between the acoustic transformer and the outer surface of the driver's acoustic cone or drive surface/driving surface can be selected to be narrow enough or close enough to enhance power of frequencies between about 4 kHz and 16 kHz, or between about 8 kHz and 14 kHz, or to have effect within narrower ranges or to extend above or below these ranges. Generally, the acoustic transformer can be applied to improve headphone performance within audible ranges and optionally above audible ranges, for example 1 kHz and up to 16 kHz, up to 20 kHz, or for example to 30 kHz or 40 kHz or higher. The distance between the acoustic transformer and the driver's drive surface when the driver is at rest or quiescent, can be selected based on a maximum deflection of the driver's acoustic drive surface from a resting or quiescent position, plus a clearance distance that is a distance between the drive surface and the acoustic transformer when the drive surface is at the maximum deflection towards the acoustic transformer. This clearance distance can be termed a dynamic clearance distance. For example, if a maximum deflection of the drive surface toward the acoustic transformer is 0.6 millimeters and a desired dynamic clearance distance is 1 millimeter, then the distance between the acoustic transformer and the driver's acoustic drive surface (e.g., a drive cone) at rest or in a quiescent state would be 1.6 millimeters, and in operation the drive surface would come no nearer than 1 millimeter to the acoustic transformer. The distance between the acoustic transformer and the driver's acoustic drive surface (e.g., a driving surface of a drive cone) at rest or in a quiescent state, can be termed a quiescent clearance distance. The maximum deflection of the drive surface or driving surface can be an absolute physical maximum that the driver can achieve but not exceed, or can be a maximum deflection distance that will occur within a given operating envelope, for example where an input signal range or input signal amplitude provided to the acoustic driver is bounded or is specified to be within particular bounds. In example embodiments the desired or specified clearance distance can be as small as 0.5 millimeters, as large as 1 centimeter, or any enumerated value between 0.5 millimeters and 10 millimeters. Example clearance distance ranges can be, for example, 0.5-1.5 millimeters, 1.0-2.0 millimeters, 1.0-3.0 millimeters, or any subset between 0.5 millimeters and 10 millimeters.

In some embodiments, apertures in the acoustic transformer can be located based on observed or determined performance anomalies of the driver, to damp or attenuate erroneous sound that can result from design or construction flaws or accepted variations in engineering tolerances. Such flaws or variations can include, for example, a driver's drive cone that is placed slightly off-center from the driver's drive coil; asymmetric mass distribution across the drive cone, resulting perhaps from excess adhesive on one side of the cone, variations in drive cone material thicknesses or densities, oil-canning of a dust cap over a center of the voice coil or drive coil, and so forth. These kinds of variations can produce local resonances or distortions, which can be masked or attenuated by strategically locating apertures in, and solid surfaces of, the acoustic transformer relative to these anomalous areas of the drive cone.

As proximity or distance becomes closer between a driving surface of the drive cone and a solid surface, lower frequency sound from the drive cone is damped and higher frequency sound is channeled or enhanced in magnitude, and motion of the driving surface is restricted or damped. For example, at locations of the driver's driving surface where low frequency sound is greater than desired, the acoustic transformer can be arranged to have a closer proximity to damp lower frequency sound and movement of the driving surface that generates the lower frequency sound. Areas of the driver's driving surface that produce more high frequency sound than is desired can have a corresponding opposite surface of the acoustic transformer arranged at a further proximity so as not to channel or enhance this higher frequency sound, or even an aperture to let the sound (and higher frequency sound channeled from elsewhere on the driver's driving surface) through toward the listener's ear. Areas of the driver's driving surface that produce less high frequency sound energy than is desired can have a corresponding opposite surface (rather than an aperture) of the acoustic transformer that is closer so as to enhance this higher frequency sound. An area of the driver's driving surface that produces a generally desirable level of high frequency sound energy can have an apertures in the acoustic transformer that is located opposite to let that sound energy through the aperture toward the listener's ear, or can have a surface of the acoustic transformer that is neither so close as to accentuate, nor so distant as to attenuate, but instead channels, the high frequency sound energy laterally or diagonally to an aperture in the acoustic transformer that is not opposite, but is instead further away from, the originating area of the drive or driving surface that produces the generally desirable level of high frequency sound energy. The aperture can have angled walls and/or extending features to help collect and/or transmit such channeled sound energy. Channeled sound energy that travels from the driver's driving surface along a surface of the acoustic transformer to one or more apertures or aperture areas in the acoustic transformer can not only be provided to locations of the listener's ear via the apertures, but the additional path length provided by this travelling (as opposed to a direct path from the acoustic driver to the listener's ear if the acoustic transformer were not present) can also provide an improvement or increased sense of realism to the listener's aural experience with the headphones, for example via phase differences resulting from the increased path length(s).

FIG. 1 shows an example acoustic transformer 102 featuring a large aperture 108 for passing lower frequencies and arranged on a first region of the transformer 102, and smaller apertures 104, 105, 106 arranged on a second side or region of the acoustic transformer 102 opposite the first region, that pass higher frequencies. The first and second regions can be semicircles, or can have other shapes and relative proportions of the acoustic transformer, for example as variously shown in the Figures. As shown in FIG. 1, an inner edge 110 of the large aperture 108 is provided with a patterned edged having regular indentations or geometric features as shown, to disperse sound waves that encounter the indentations or geometric features and thus help prevent acoustic resonances that would distort sound perceived by the listener. As shown in FIG. 1 an in accordance with an embodiment, the two-dimensional area of the large aperture 108 exceeds the two-dimensional combined area of the smaller apertures 104, 105, 106. The circumference of the acoustic transformer 102 can match or approximate a circumference of a driver to which it is paired, for example a driver having a diameter of about 40 millimeters. Thus the acoustic transformer can be sized to match a particular make and/or model of driver. Alternatively, in example embodiments the acoustic transformer can be generally sized to be compatible with a range of drivers of different size and design, and provide some measure of improvement for those different drivers.

Figure 14:
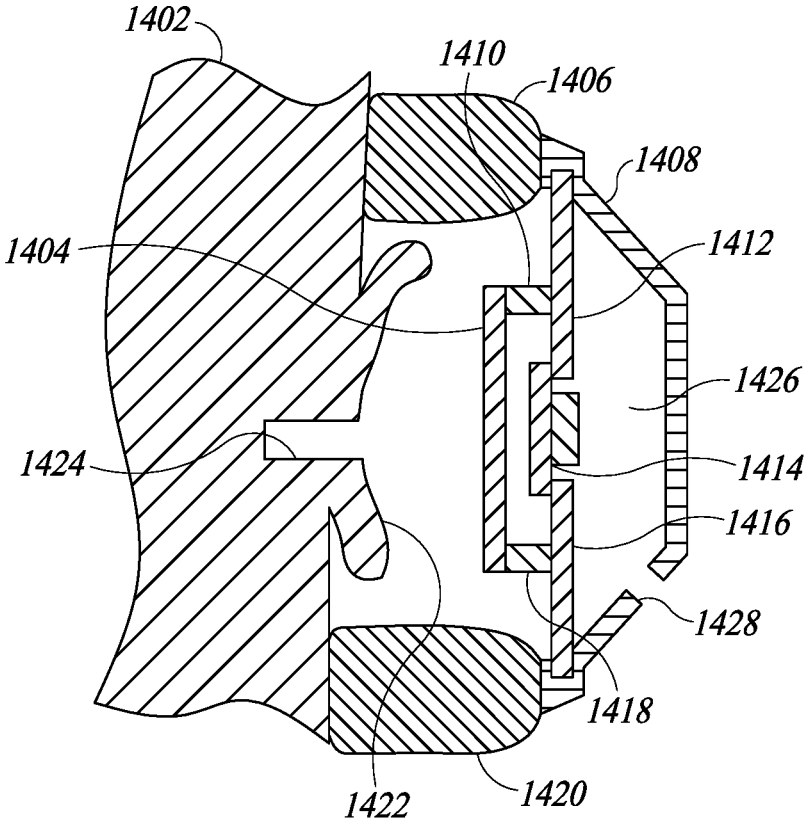
FIG. 14 shows a cross-sectional side view of a headphone ear cup equipped with an acoustic transformer and located over a listener's ear.

FIG. 14 shows how acoustic transformers according to example embodiments described herein, can be integrated into a headphone. In particular, FIG. 14 illustrates a side view with cross-sectional aspects of a headphone ear cup that is equipped with an acoustic transformer and located over a listener's ear. A portion 1402 of the listener's head includes the pinna or outer ear 1422 of the listener, and the listener's ear canal 1424 is also shown. An acoustic transformer 1404 is located opposite the listener's ear, between a driver 1414 and the listener's ear. The acoustic transformer 1404 can be, for example, the acoustic transformer 102 of FIG. 1. The view of FIG. 14 is perpendicular to the view shown in FIG. 1, showing a side or edge view instead of the front view of FIG. 1. Ear cup elements 1406, 1420 are fastened or otherwise attached to a housing 1408 that forms a structure surrounding and supporting an interior mount with sides 1412, 1416 that in turn support the driver 1414. The acoustic transformer 1404 is also supported by the interior mount, for example with standoffs or flanges 1410, 1418 respectively located between the acoustic transformer 1404 and the interior mount sides 1412, 1416. The housing 1408 can form a cavity 1426 on the back side of the driver 1414, and optionally there can be vents in the housing 1408 connecting the cavity 1426 to an outside environment, for example the vent 1428. Elements of the headphone ear cup can be variously and appropriately made of different materials, for example the elements 1406, 1420 can be made with plastic foam, can include gel, and so forth, and the housing 1408 can be made of plastic or other suitable material. Different mounting configurations can be used to support the acoustic transformer 1404 and the driver 1414 other than those shown. For example, the acoustic transformer 1404 can have integral mounting flanges, and/or the interior mount sides 1412, 1416 can be shaped differently to support the acoustic transformer 1404 at any desired distance from the driver 1414.

Figure 15:
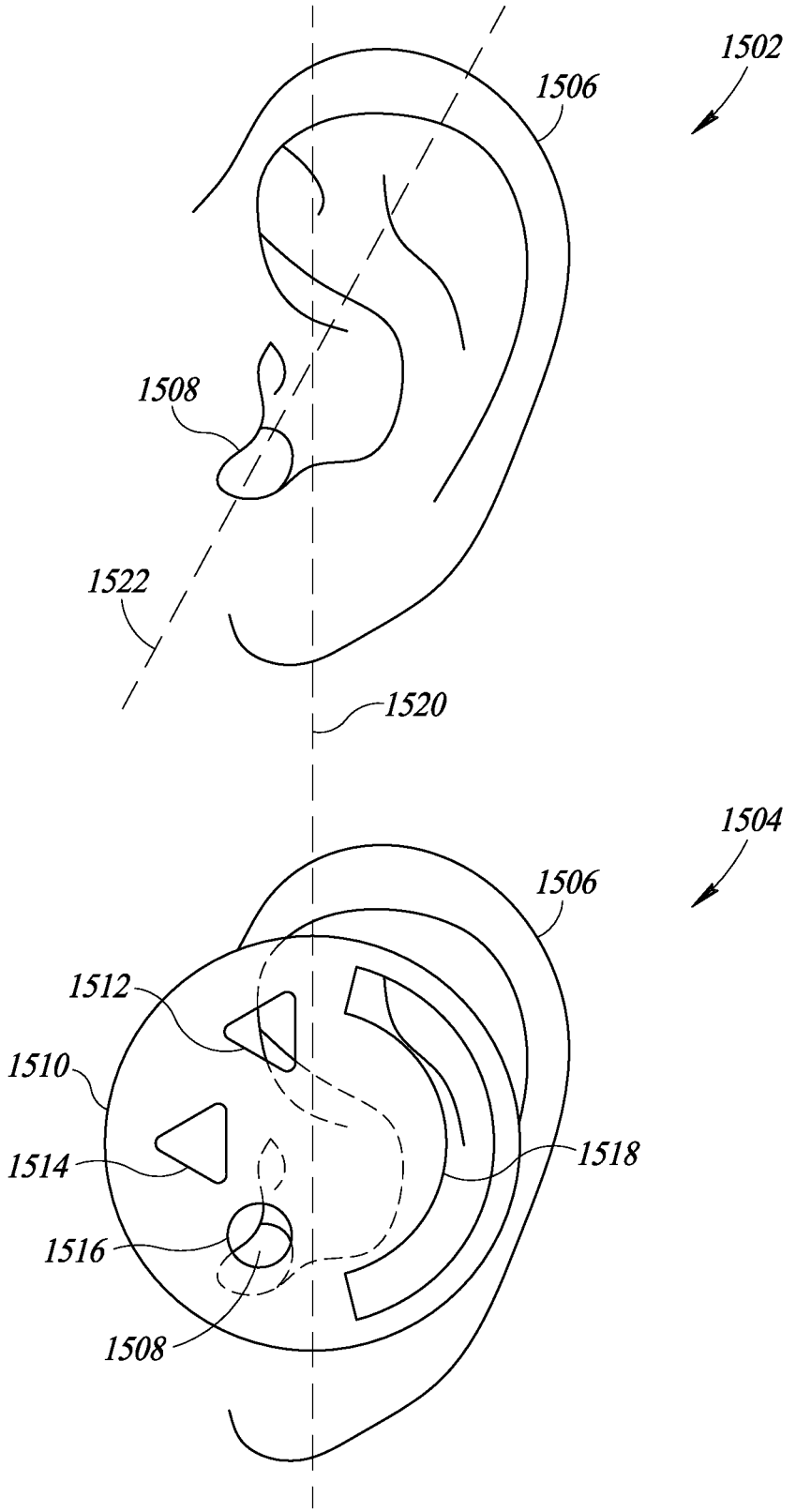
FIG. 15 shows an example orientation of an acoustic transformer with respect to a listener's ear.

FIG. 15 illustrates an example orientation of an acoustic transformer with respect to an exemplary listener's ear. A first view 1502 shows the listener's pinna 1506 and ear canal opening 1508, with reference to an axis 1520 that represents a vertical axis of the listener with the listener's head in an erect posture, gazing horizontally. The axis 1520 can also be considered to be a vertical axis of the listener's head, as seen from a side of the listener's head. FIG. 15 shows an ear centerline 1522 passing through a center of the listener's ear canal opening 1508 and a geometric center of an upper portion of the listener's pinna 1506. As can be seen from the position of the ear centerline 1522 with respect to the axis 1520, the listener's ear is angled slightly backward with respect to the vertical axis 1520. Most people's ears are angled slightly backward roughly 10-15 degrees, with individual variations and statistical outliers that can fall outside this range.

As shown in the second view 1504 of FIG. 15, an acoustic transformer 1510 is generally aligned with the vertical axis 1520 so that the large aperture 1518 is on one side of the axis, and the smaller apertures 1512, 1514, 1516 are on the other side of the vertical axis 1520. This places the large aperture 1518 adjacent to, or near, the rear of the pinna 1506 and the smaller apertures 1512, 1514, 1516 adjacent to, or near, a forward section of the pinna 1506. One or more of the smaller apertures can optionally overlap the ear canal opening 1508 in part, as shown, or in whole (so that the larger of the aperture or the ear canal opening would completely cover the other). In some example embodiments, the acoustic transformer is generally aligned with the vertical axis 1520 within a tolerance margin, for example within plus or minus 10 degrees, or plus or minus 15 degrees, or within other tolerances that may be smaller than 10 degrees or greater than 15 degrees. In other embodiments the acoustic transformer is generally aligned with the listener's ear centerline 1522, for example within plus or minus 5 degrees, or plus or minus 10 degrees, or plus or minus 15 degrees, or within other margins that may be smaller or greater. Although a particular acoustic transformer 1510 is shown in FIG. 15, any of the acoustic transformers variously shown in the Figures and/or described herein can be arranged or oriented with respect to a listener's ear or head according to the same principles and in a same or similar fashion as shown and described with respect to FIG. 15.

It will be recognized that how the listener chooses to wear headphones equipped with acoustic transformers can affect how the transformers align with the listener's ears. Generally the acoustic transformers can be oriented within headphone ear cups so that when the headphones are worn in accordance with their intended design purpose, for example with a headband extending between the headphone ear cups over the top of the listener's head, the acoustic transformers are generally aligned with a vertical axis of the listener's head or are generally aligned with the listener's ear centerline (or both). For example, in some embodiments the acoustic transformers can be aligned with the headband of the headphones, with the set of smaller apertures toward the front of the headband and the larger aperture toward the rear of the headband. In some embodiments that feature headphones equipped with acoustic transformers such as those variously described herein, the acoustic transformers are mounted in such a way that the listener can rotate or re-orient them within the headphone ear cups, and/or can rotate or re-orient the ear cups with respect to a headband or other support structure of the headphones, so that the acoustic transformers are advantageously aligned with the listener's ears when the listener is wearing the headphones in a particular or preferred position or fashion. Thus in some embodiments the listener can customize orientation of the acoustic transformer to match his or her preference.

Figure 2:
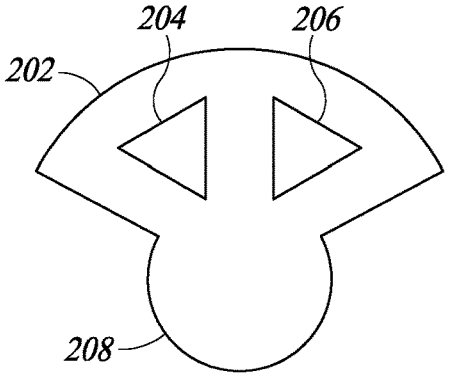
FIG. 2 shows a second exemplary acoustic transformer.

FIG. 2 illustrates another example acoustic transformer 202, having smaller apertures 204, 206 of triangular shape for passing higher frequencies, and having an opposite side of the acoustic transformer 202 cut away so that when the acoustic transformer 202 is mated or matched to a driver, a larger aperture will be formed, which can have a smooth edge, for example a smooth edge as shown by the smooth, inner edge 208, rather than an indented or textured edge.

Figure 3:
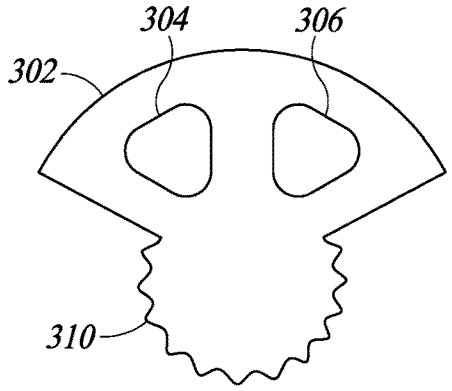
FIG. 3 shows a third exemplary acoustic transformer.

FIG. 3 illustrates another example acoustic transformer 302, similar to that of FIG. 2 but whose smaller apertures 304, 306 have a rounded shape and whose inner edge 310 that forms part of a larger aperture, includes an indented or textured edge, for example to help prevent or ameliorate resonances or distortions from sound reflected off the inner edge 310.

Figure 4:
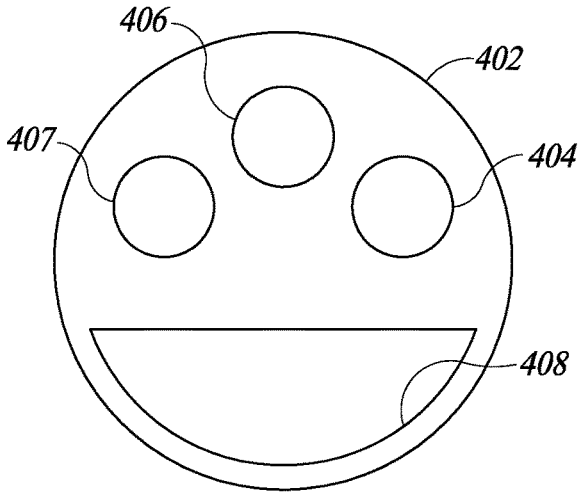
FIG. 4 shows a fourth exemplary acoustic transformer.

FIG. 4 illustrates a fourth example acoustic transformer 402, having three smaller apertures 404, 406, 407 having a circular shape, and a larger aperture 408 located close to an outer edge of the acoustic transformer 402 and being formed by an arc and a straight line both have smooth contours.

Example embodiments of acoustic transformers described herein, for example including those shown in FIGS. 1-4, include apertures that pass completely through a surface of the plate, disc or element of which they are formed, so that an aperture forms part of a free air path from an acoustic surface of the driver, through the acoustic transformer, to the listener's ear.

In other example embodiments, one or more of the apertures or aperture locations can be substituted with areas that have some physical barrier, such as a lesser thickness of material of the acoustic transformer or a different material or a membrane such as Mylar™, that is flexible and/or has other properties that provide a different acoustic impedance than surrounding portions of the acoustic transformer. Such locations can effectively act as acoustic apertures to pass more sound energy than other portions of the acoustic transformer. In addition, the materials and thicknesses at those acoustic apertures can be tuned to pass certain sound frequencies or frequency bands or ranges, and/or to enhance or reduce desired path delays. Exemplary materials can include, for example, cloth, cotton, plastic, metal, wood, or any other substance in any appropriate configuration (layered, felted, forming a matrix, forming one or more membranes, and so forth).

Figure 12:
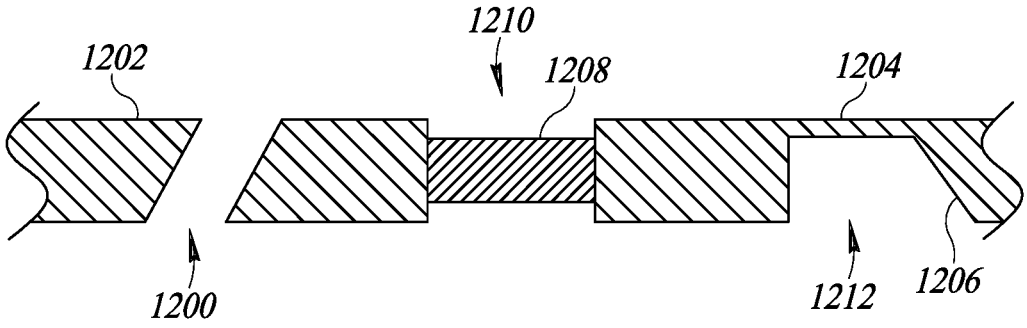

An example embodiment is shown in FIG. 12, which includes a cross-sectional view of an acoustic transformer 1202 having a different material 1208 in an aperture 1210, that generally attenuates, or filters particular frequency ranges of, sound passing through the aperture 1210. For example, the material 1208 can change an acoustic transparency of the aperture 1210, for example attenuate some particular frequencies or generally all frequencies of sound passing through the aperture 1210. Such acoustic filtering can be applied selectively to different apertures in an acoustic transformer, so that one or some of the apertures include filtering (e.g., have material in the aperture that acts as a filter element to provide a filtering effect), but not all of the apertures include filtering. Additionally or alternatively, different filtering can be applied to different apertures. Also shown in FIG. 12 is a thinner section 1204 of the acoustic transformer 1202 that effectively acts as an acoustic aperture 1212 through which more sound passes than through adjacent, thicker sections of the acoustic transformer 1202. FIG. 12 also shows an example embodiment where an aperture 1200 is angled rather than perpendicular or orthogonally situated with respect to the acoustic transformer 1202, and also an angled wall of an aperture, such as the wall 1206 of the aperture 1212. The features shown in FIG. 12 are shown relatively close together for purposes of efficient illustration, but can be distributed or scaled in any appropriate fashion.

Figure 10:
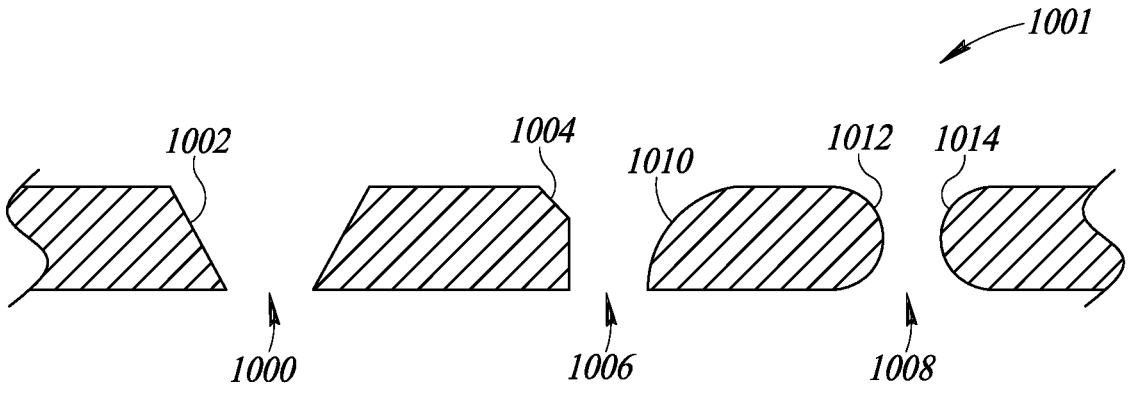
FIGS. 10-12 show cross-sectional views of example acoustic apertures in sections of acoustic transformers.
Figure 11:
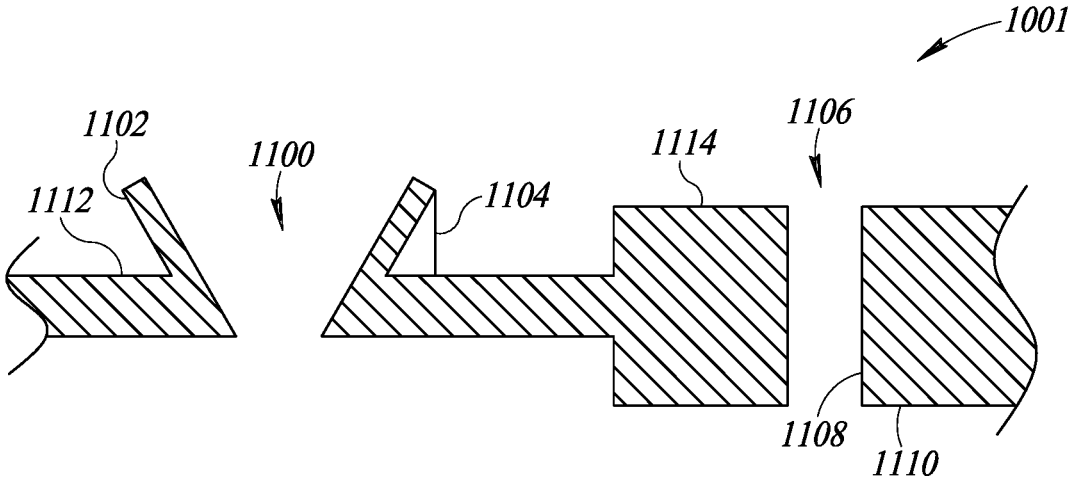

FIGS. 10 and 11 show cross-sectional views of acoustic transformer featuring different aperture details in accordance with additional embodiments. As shown in FIG. 10, an acoustic transformer section 1001 can include an aperture 1000 with a horn shape that is larger on one side of the acoustic transformer than on the other side, due to angled aperture walls such as the wall 1002. Walls and edges of apertures can have different shapes, for example a beveled edge 1004 or a rounded edge 1010 as shown with respect to aperture 1006, as well as rounded edges on both sides of the acoustic transformer as illustrated by the curved walls 1012, 1014 of the aperture 1008.

As shown in FIG. 11, aperture features can extend outward from a surface of an acoustic transformer, for example to further guide or accentuate sound passing through the aperture. For example, a wall 1102 of an aperture 1100 can extend above a surface 1112 of an acoustic transformer section 1101, and walls such as the wall 1102 can be supported by ribs or flanges such as the rib 1104. In addition, an aperture with longer walls, such as the aperture 1106 with extended wall 1108, can be formed by thicker sections 1110, 1114 of the acoustic transformer section 1101. Outer edges of an acoustic transformer can be extended and/or shaped to provide mounting flanges or surfaces with which to attach or facilitate location of the acoustic transformer relative to a driver and/or within a headphone ear cup.

It will be understood that aperture features of example acoustic transformers can exhibit a variety of features, including not limited to thickened portions of acoustic transformer material, extensions, apertures that are variously angled and/or have differing contours and surface area as they extend from one side of an acoustic transformer to another, ribbed or flanged supports or splines, chamfered or otherwise contoured edges, regular edge variations such as indentations or recesses with different geometric shapes or contours, as well as irregular edge variations, and so forth. Raised areas or extensions fully or partly surrounding an aperture can have cylindrical, conical, trapezoidal or other shapes, with different flaring or radii. In addition, as earlier discussed, example acoustic transformers can have surfaces contoured to provide differing distances between surface locations of the acoustic transformer and the driver's drive surface to tailor frequency response or enhancement as well as compensate for driver performance anomalies.

Figure 5:
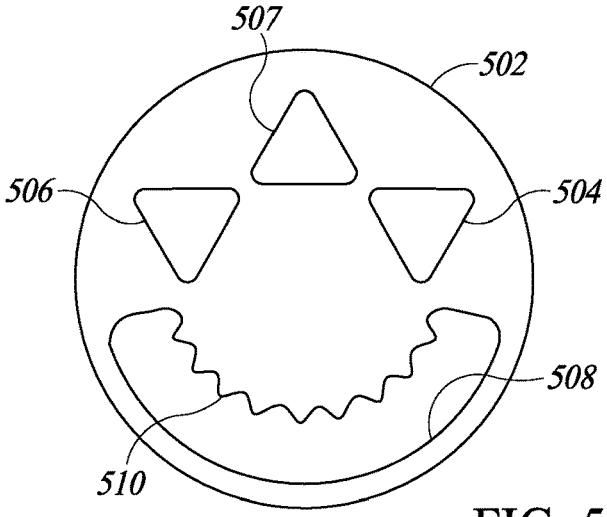
FIG. 5 shows a fifth exemplary acoustic transformer.

FIG. 5 illustrates another example acoustic transformer 502 having three smaller apertures 504, 506, 507 and a larger aperture 508 along an opposite side or edge of the acoustic transformer 502 that extends about half-way round the acoustic transformer and includes a textured inner edge 510. Also of note is that the smaller apertures 504, 506, 507 have rounded triangular shapes each with a vertex furthest from a center of the acoustic transformer 502 and a side of the triangular shapes nearest a center of the acoustic transformer 502. This effectively locates more area of smaller apertures 504, 506, 507 closer to a center of the acoustic transformer 502. This structure can enhance passage of higher frequency sound from the driver through the acoustic transformer 502 to the listener's ear, because measured across the driver, lower frequencies generally come off the driver with greater intensity or power towards an outer circumference or from longer radii of the driver, whereas higher frequencies tend to come off drivers with greater intensity toward a center or along smaller radii of the driver. Said differently, many commercially available drivers produce more of their higher frequency sound intensity or power near a center of the driver, and more of their lower frequency sound intensity or power from outer portions of the driver, further from the center. Other shapes than the triangular shapes shown in FIG. 5 can be used, that vary in width depending on radial distance from a center of the driver, based on an energy/frequency distribution of sound coming off the driver at that radial distance and a desired energy/frequency distribution on the ear-side of acoustic transformer 502. Note that for a circular driver with a drive cone driven by round, concentric electromagnetic components, an energy/frequency distribution of sound coming off the driver will generally be consistent along a circle formed or defined by a given radial distance from a center of the driver, subject to such influences as manufacturing variations or tolerances that may give rise to some differences, and possibly also transient harmonics or reflections across the driver. In some embodiments, for example those shown in FIGS. 5, 6, 7, and 15 in particular, boundaries and/or geometric centers of the smaller apertures are located closer to the center of the driver's drive surface than are boundaries and/or geometric centers of the larger apertures.

Figure 6:
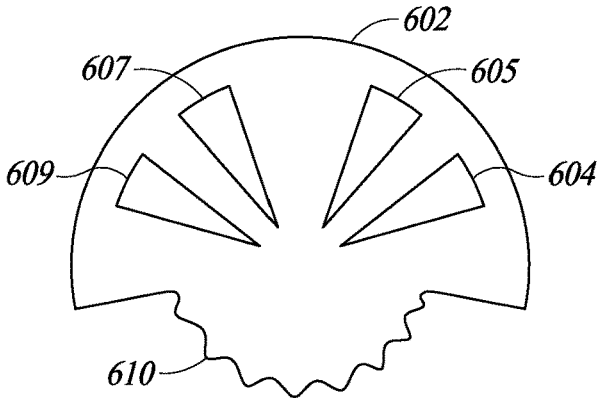
FIG. 6 shows a sixth exemplary acoustic transformer.

FIG. 6 illustrates a sixth example acoustic transformer 602 that is similar in configuration to that of the acoustic transformers shown in FIGS. 2 & 3, but having four smaller apertures 604, 605, 607, 609 that extend along radii of the acoustic transformer 602 with an isosceles shape, and whose larger aperture is formed along less than half of a disc that would encompass the acoustic transformer 602. An inner edge 610 of the acoustic transformer 602 includes contours or texturing, as described for example respect to FIGS. 1, 3 and 5.

Figure 7:
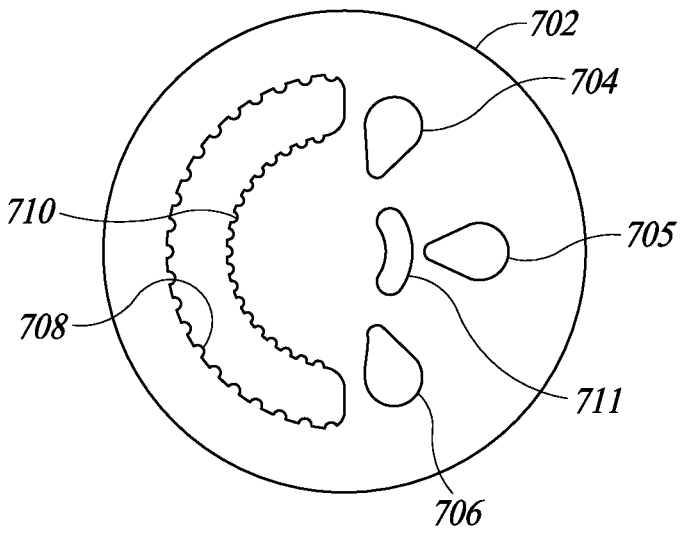
FIG. 7 shows a seventh exemplary acoustic transformer.

FIG. 7 illustrates another example acoustic transformer 702 having three smaller apertures 704, 705, 706 that have rounded triangle or teardrop shapes each with a vertex (rather than a side contour) nearest a center of the acoustic transformer 702. A large aperture 708 extends near an outer circumference of the acoustic transformer 702 along at least half (180 degrees) of a disc of the acoustic transformer 702, with indentations or textured contouring along all the edges of the larger aperture 708 including an inner edge 710. The acoustic transformer 702 also includes a centrally-located small aperture 711 that is elongated and can have a curvature, to pass high-frequency sound emanating from a center of a driver paired with the acoustic transformer 702.

Figure 8:
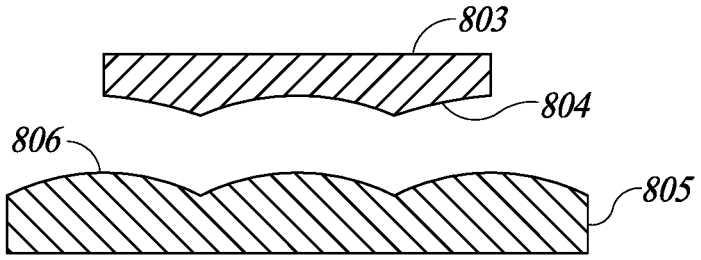
FIG. 8 shows a side cross-sectional view of an example acoustic transformer with a first contour that complements that of a driver opposite.

FIG. 8 illustrates an example relationship between a center section 803 of an example acoustic transformer that is located opposite a driver 805. The driver 805 is shown, for simplicity's sake, as a single object rather than as a composite object having multiple components such as a speaker cone, dust cap, and driving coil. Of note are contours of the respective surfaces 804, 806 of the acoustic transformer section 803 and the driver 805—matching convex to concave, to facilitate air compression between the acoustic transformer section 803 and the driver 805 and thus enhance or preserve intensity of higher frequency sound generated near a center of the driver 805.

Figure 9:
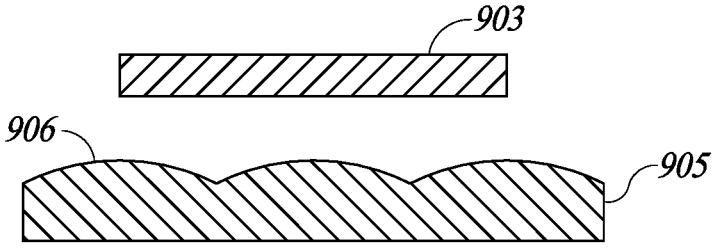
FIG. 9 shows a shows a side cross-sectional view of an example acoustic transformer with a second contour that complements that of a driver opposite.

FIG. 9 illustrates an embodiment similar to that of FIG. 8, but where an acoustic transformer section 903 has an inner surface with a straight or flat contour instead of a concave contour, opposite a convex surface 906 of a center of a driver 905. This can be used, for example to provide some enhancement or preservation of higher frequency sound from the driver 905, for example higher frequency sound coming off the convex surface 906 since a center of the convex surface 906 is closer to the acoustic transformer section 903 than outer portions of the convex surface 906, while enabling a lower cost or simpler acoustic transformer.

Distances between the acoustic transformer sections and the respective drivers shown in FIGS. 8, 9 can be easily tuned depending on the specific drivers used to generate acceptable improvements in higher-frequency performance of the driver/acoustic transformer system.

As demonstrated by acoustic transformers shown in FIGS. 1-7, the number and relative placement of smaller apertures can vary. In example embodiments, the smaller apertures are each smaller than the larger aperture, and the larger aperture can be located more towards an outer edge of the acoustic transformer than the smaller apertures. In some embodiments, an area of the larger aperture can exceed the combined area of the smaller apertures in a given acoustic transformer. In other embodiments featuring a larger aperture and multiple smaller apertures, the combined area of the smaller apertures can exceed the combined area of the larger aperture. Example acoustic transformers can be disc shaped, as in FIG. 1, or can be formed from a fraction of a disc, as shown for example in FIGS. 2, 3 and 6, or can have other shapes, two-dimensional outlines for example, that correspond or pair with an acoustic driver.

In some acoustic transformer embodiments, all of the smaller apertures in an acoustic transformer have the same shape, and/or have a same area. In other embodiments, at least some of the smaller apertures have both different area and different shape from each other. In some embodiments, an area of each of one or more of the smaller apertures can be within a range (inclusive) of 5% to 10% of the area of a largest aperture or aperture area of the acoustic transformer, or can be within a range (inclusive) of 10% to 15% of the area of the largest aperture or aperture area, or can be within a range (inclusive) of 15% to 20% of the area of the largest aperture or aperture area, or can be within a range (inclusive) of 20% to 25% of the area of the largest aperture or aperture area, or can be within a range (inclusive) of 25% to 30% of the area of the largest aperture or aperture area of the acoustic transformer. Thus, for example, an acoustic transformer could have four smaller apertures each with an area that is 25% of an area of the largest aperture; or one with an area of 10% of the area of the largest aperture or aperture area, the second and third with an area of 20%, and the fourth with an area of 30%; or the first with an area of 5%, and the second, third and fourth each with areas of 10%; or all four each with an area of 30%; or a first with 7%, a second with 13%, and the third and fourth with 17%; and so forth.

Figure 13:
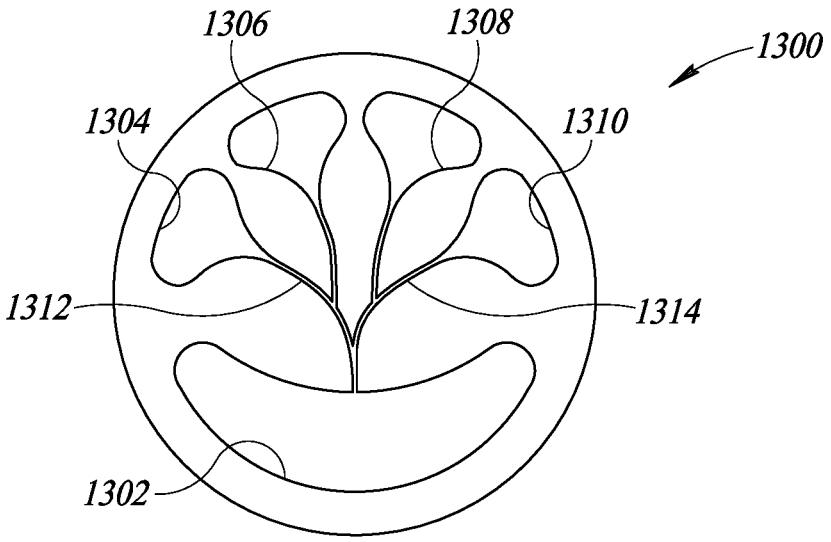
FIG. 13 shows an example embodiment of an acoustic transformer having multiple smaller aperture regions and a larger aperture region that are connected by slots.

FIG. 13 shows an example embodiment of an acoustic transformer 1300 having multiple smaller apertures or aperture regions 1304, 1306, 1308, 1310 and a larger aperture or aperture region 1302, that are connected by narrow slots or passageways such as the slots 1312, 1314. Thus FIG. 13 literally shows one aperture composed of different aperture regions 1302, 1304, 1306, 1308, 1310 contiguously connected by slots or narrow passageways such as the slots 1312, 1314. However, in this embodiment the slots are narrow enough so that they have an acoustic effect that is below a predetermined threshold value and the acoustic effects of the aperture regions or areas 1302, 1304, 1306, 1310 have beneficial effect above another, predetermined threshold value. In other words, any detrimental acoustic effects of the narrow slots connecting the aperture regions are negligible or acceptable in comparison to the benefits provided by the aperture regions 1302, 1304, 1306, 1310 in accordance with various embodiments. Such slots can be included, for example, for ease of manufacturing or other reasons. In some embodiments, a slot can be included to link the smaller apertures or smaller aperture regions (for example, those that would be located opposite or near a front of a listener's ear) and provide additional area for higher frequency sound to pass through the acoustic transformer. A width of a slot connecting smaller apertures can, for example, be 5-15% of a width or length of an aperture to which it connects. Advantageously, in embodiments that use acoustic drivers having electromagnetic or "voice" coils to drive the acoustic driving surface of the driver, one or more of the smaller apertures can be arranged so that the aperture is located over, or overlies, an outer edge or perimeter of the coil. This is shown for example in FIGS. 17 and 18, described in further detail below. Outer edges of these coils can be "hot spots" for higher frequency sound energy generated by the acoustic driver, and smaller apertures can be advantageously located over them to pass this energy and can be sized or tuned to pass an amount of higher frequency sound energy that results in a listening experience that pleases a listener or a majority or a plurality of listeners.

In addition, where indentations and/or extensions are provided along part or all of an edge of a larger aperture formed or within an acoustic transformer, the indentations or recesses and extensions can be provided with different shapes—regular polygonal shapes such as squares, or triangles/sawteeth, or semicircular "teeth" with flat segments between them, thus forming a regular texture, and the ratios of protrusion to recess of the indentations and/or extensions or textured contours can vary (even, greater length of recess, or greater length of protrusion). Additionally or alternatively, irregular or randomized edge textures can also be provided, for example a sandpaper-type texture, and can be three-dimensional (having texture along a long axis or direction of the acoustic transformer as well as along a thickness or depth of the acoustic transformer).

Figure 17:
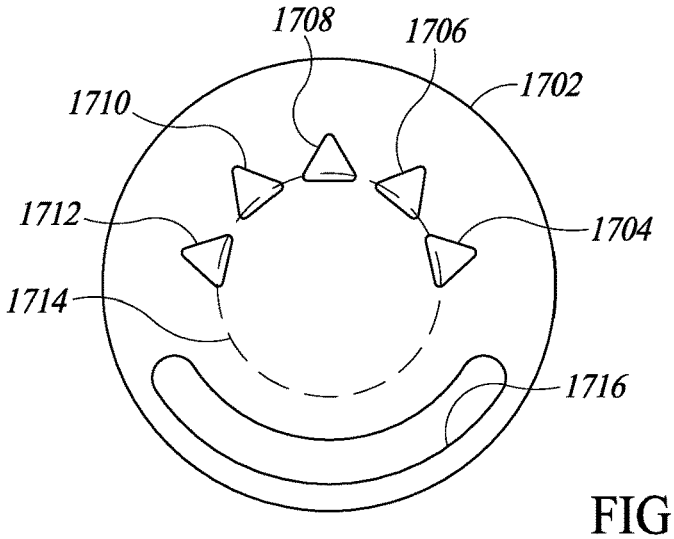
FIG. 17 shows an example acoustic transformer with respect to a driver's drive coil.

FIG. 17 shows an acoustic transformer 1702 having smaller apertures 1704, 1706, 1708, 1710 and 1712 located along an outer perimeter 1714 of a drive coil of a driver, and a larger aperture 1716 located outside the drive coil outer perimeter 1714.

Figure 18:
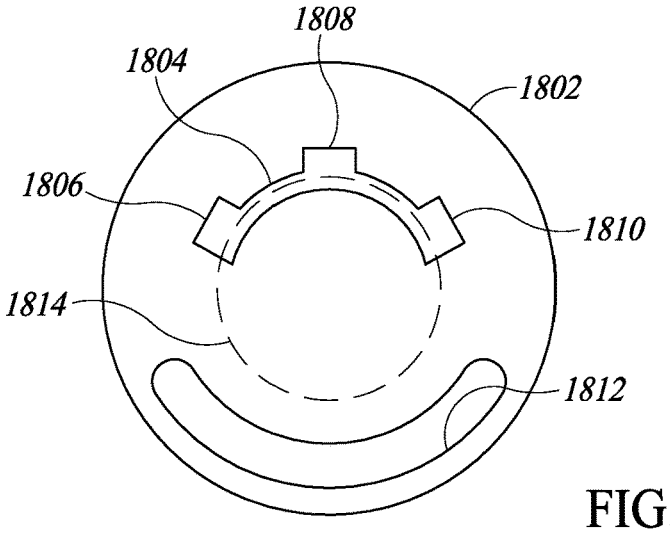
FIG. 18 shows another example acoustic transformer with respect to a driver's drive coil.

FIG. 18 shows an acoustic transformer 1802 having a larger aperture 1812 located outside a drive coil outer perimeter 1814, and a single, smaller aperture 1804 that is narrow and located along a portion of the driver coil outer perimeter 1814, with additional aperture extensions 1806, 1808 and 1810 extending outward from the narrow length of the aperture 1804. This allows energy from the higher frequency "hot spot" or band of the drive coil outer perimeter to be metered in amount and channeled toward an inner part of the listener's pinna, consistent with principles and techniques described herein.

Figure 19:
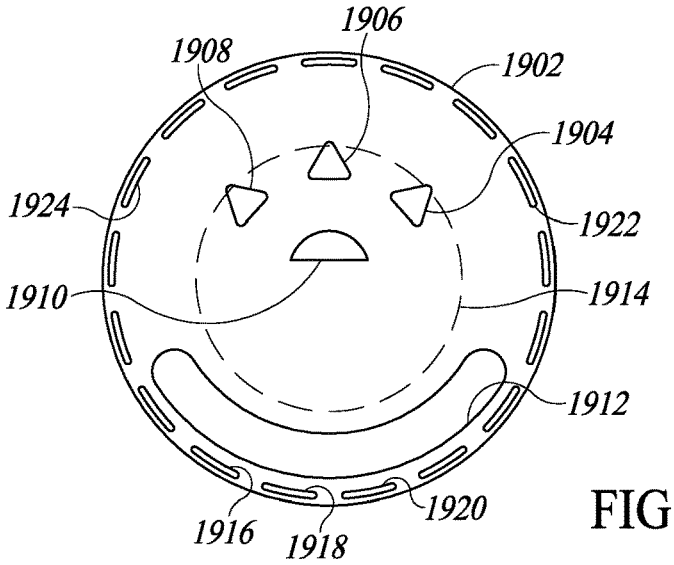
FIG. 19 shows another example acoustic transformer with respect to a driver that is larger than a listener's ear.

FIG. 19 shows an acoustic transformer 1902 configured to cover or encompass an acoustic driver that is larger than a listener's ear, for example an acoustic driver that extends beyond most or all of a listener's pinna. As shown in FIG. 19, the acoustic transformer 1902 includes smaller apertures 1904, 1906, 1908 which can lie inside an outer perimeter 1914 of a drive coil of the acoustic driver or, as shown, can lie on the drive coil outer perimeter 1914. In contrast with FIG. 17, which shows wide portions of the smaller apertures 1704, 1706, 1708, 1710, 1712 overlapping the drive coil outer perimeter 1714, as shown in FIG. 19 in some embodiments narrow portions of the smaller apertures can overlap the drive coil outer perimeter. One reason can be to meter or allow a smaller amount of higher frequency energy from the acoustic driver through the acoustic transformer to the listener's ear. In particular as shown in FIG. 19, narrow portions of the smaller apertures 1904, 1906, 1908 are positioned over the drive coil outer perimeter 1914. FIG. 19 also includes a smaller aperture 1910 located within the driver coil outer perimeter 1914. FIG. 19 also includes a larger aperture 1912, located outside the driver coil outer perimeter 1914, consistent with other embodiments described herein. FIG. 19 further includes smaller apertures such as the smaller apertures 1916, 1918, 1920, 1922, 1924 located near an outer edge of the acoustic transformer 1902, further from a center of the acoustic transformer 1902 than the larger aperture 1912. These smaller apertures such as the smaller apertures 1916, 1918, 1920, 1922, 1924 can for example as shown in FIG. 19 extend all the way around a perimeter of the acoustic transformer 1902, and many or all of them (for example, at least half) can lie outside the listener's pinna, or other words, lie in an area of the acoustic transformer 1902 that extends beyond the listener's pinna and doesn't overlap or overlie the listener's pinna. In example embodiments where this is the case, these smaller apertures along the perimeter of the acoustic transformer 1902 can vent extra, un-needed lower frequency energy provided by an acoustic driver that extends beyond some or all of the listener's pinna. Some higher frequency sound energy from the acoustic driver will also be vented through these smaller apertures such as the smaller apertures 1916, 1918, 1920, 1922, 1924, but it will be vented outside a perimeter of the listener's pinna and/or along outer portions of the listener's pinna. Because of this and the fact that higher frequency sound is more directional than lower frequency sound, most or all of the higher frequency sound vented through the smaller apertures won't be captured by the listener's pinna and thus will be effectively (and desirably) vented away from the listener's ear or hearing.

Figure 20:
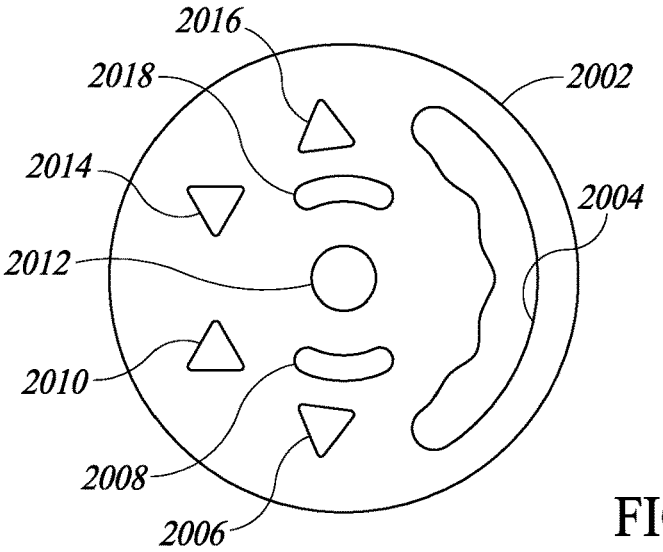
FIG. 20 shows an example acoustic transformer for use with an aperture cover.

FIG. 20 shows an acoustic transformer 2002 that together with an aperture cover 2102 shown in FIG. 21, form an assembly that includes a central aperture and an aperture located below it, that both direct sound at a downward angle toward a listener's ear canal. As described in further detail below, provision of both the acoustic transformer 2002 and the aperture cover 2102 enables the two to be combined in a first configuration for use with a listener's right ear, or in a second configuration for use with a listener's left ear.

In particular, FIG. 20 shows an acoustic transformer 2002 having smaller apertures 2006, 2010, 2014, 2016 and a larger aperture 2004. The acoustic transformer 2002 also includes a central aperture 2012 and two curved apertures 2008, 2018 located at similar radial distances from the central aperture 2012. FIG. 21 shows an aperture cover 2102 located over the acoustic transformer 2002. The aperture cover 2102 includes an aperture 2106 located near a center of the aperture cover 2102, and an aperture 2108 located further from the center of the aperture cover 2102. In an example embodiment the aperture 2108 can have a diameter of 2 millimeters, and the aperture 2106 can have a diameter of 3 millimeters. Other aperture sizes can alternatively be used, for example smaller, ranging from 1 to 2 millimeters for the aperture 2108 and ranging from 2 to 3 millimeters for the aperture 2106, or larger, for example ranges of 2-3 millimeters for the aperture 2018 and 3-4 millimeters for the aperture 2106. The apertures 2106, 2108 can be provided in shapes different than a circle, for example they can be variously circular, oval, polygonal, or a combination thereof.

Figure 21:
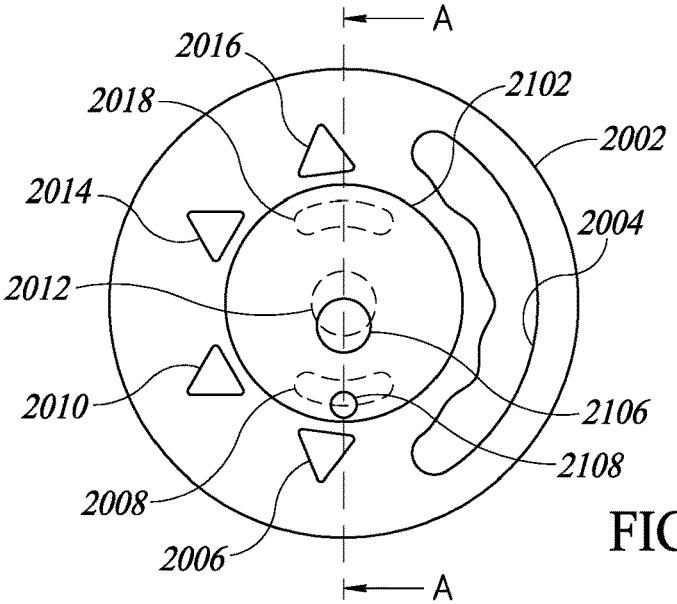
FIG. 21 shows the acoustic transformer of FIG. 20 with an aperture cover.
Figure 22:
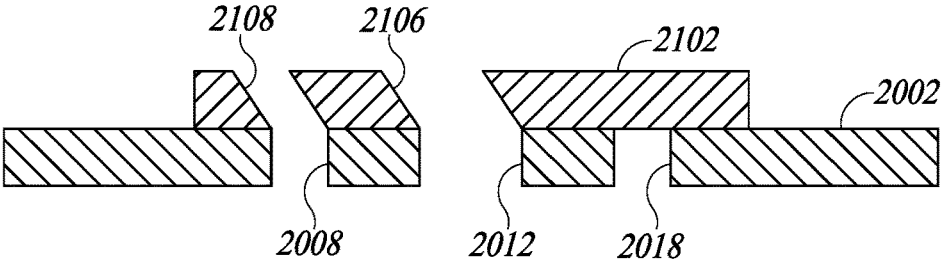
FIG. 22 shows a side cross-sectional view of the acoustic transformer and aperture cover of FIG. 21.

FIG. 22 shows a cross-sectional side view of the acoustic transformer 2002 and the aperture cover 2102, along the line A-A shown in FIG. 21. As shown in FIG. 22, the apertures 2108, 2106 are angled so to direct sound downwards toward a listener's ear canal when the acoustic transformer 2002 and the aperture cover 2102 are mounted within a headset ear cup arranged in contact with a listener's head, as for example consistent with the arrangements shown in FIGS. 14 and 15. In an example embodiment the aperture cover 2102 is located between the listener's ear and the acoustic transformer 2002, so that the combination of acoustic transformer and aperture cover shown in FIG. 21 would be suitable for placement in a right-side ear cup for placement over a listener's right ear. Provision of the two curved apertures 2018, 2008 in the acoustic transformer 2002 means that the acoustic transformer 2002 and the aperture cover 2102 can easily be assembled or matched for a listener's right ear, or a listener's left ear. For example, if the aperture cover 2102 shown in FIG. 21 were rotated clockwise 180 degrees so that the aperture 2108 were located over the aperture 2018 instead of the aperture 2008, then the combination of the acoustic transformer 2002 and the aperture cover 2102 would be suitable for use in a headphone ear cup for placement over the listener's left ear. In an example embodiment, the curved apertures 2018, 2008 are located on, or just inside, an inner perimeter of a drive coil of a driver paired with the acoustic transformer 2002.

Alternatively in an example embodiment, instead of providing an acoustic transformer with apertures 2018 and 2008 and also the aperture cover 2102, the aperture cover 2102 can be omitted and the acoustic transformer can instead be provided with the central aperture 2012 and an aperture corresponding to the aperture 2108 (instead of the apertures 2018, 2008). In this embodiment there would be a left ear version and a right ear version of the acoustic transformer, with placement of the large aperture 2004, and the smaller apertures 2006, 2010, 2014, 2016 swapped about an axis formed by the aperture 2012 and the aperture corresponding to the aperture 2108 so that the large aperture 2004 in each headphone ear cup will be located opposite a rear portion of the listener's pinna when the headphones are arranged on the listener's head. In this embodiment the central aperture 2012 and the aperture corresponding to the aperture 2108 can also be angled, consistent with angles of the apertures 2108, 2106 as shown for example in FIG. 22.

Angled apertures such as the apertures 2106, 2108 shown in FIGS. 20, 21 can be similarly implemented with other acoustic transformers, either with an aperture cover or with dedicated left and right versions of an acoustic transformer that omits an aperture cover. In other words, other acoustic transformers such as those shown in FIGS. 1-5 can be similarly adapted to include apertures like the apertures 2106, 2108.

Different drivers can come in different sizes and configurations, and acoustic transformers can be provided to match them according to principles and illustrations described herein. Example acoustic transformers can be larger than, smaller than, or coextensive with, drive surfaces of the drivers. For example, different embodiments acoustic transformers can extend beyond or stay within outer circumferences of the driver surfaces, and can be configured to match acoustic characteristics and anomalies of particular drivers, or models of drivers, or types of drivers. For example, in a situation where an active drive surface of a driver exceeds dimensions of a listener's ear in one or more dimensions or directions, in accordance with example embodiments an acoustic transformer can be sized to match dimensions of the active drive surface, with apertures or aperture regions strategically aligned with the listener's ear, for example as earlier described. Alternatively, an acoustic transformer can be sized to primarily interact with portions of the active drive surface that are directly opposite the listener's ear. Optionally, elements of the acoustic transformer that extend beyond boundaries of a listener's ear can be blocked or damped by adjacent or corresponding elements of an acoustic transformer, for example by absence of apertures or aperture regions, and optionally with sound-absorbing or deflecting material provided at those adjacent or corresponding elements of the acoustic transformer. In addition, drivers can have a total perimeter, or a perimeter of an active or sound-generating surface as presented toward a listener's ear or in an intended direction of sound propagation, that is round. Alternatively, one or both of these perimeters can have different polygonal or rounded shapes such as hexagonal, polygonal, round, elliptical, oval, egg-shaped, polygon with some straight edges and some curved edges, or any other appropriate shape, and acoustic transformers as described herein in can also be shaped to match or be compatible with one or both of the total perimeter or the active surface perimeter of the driver.

Those of ordinary skill in the art will recognize that acoustic transformers as described herein can be made of different materials and/or composites of materials, including but limited to plastics, metals, glass, ceramic, wood, or other material or composite of suitable materials having appropriate characteristics, for example rigidity, consistency and/or acoustic opaqueness.

Dynamic cone or coil drivers have been described and shown herein with respect to example embodiments. Example embodiments of an acoustic transformer consistent with those described and shown herein can also be implemented in conjunction with different kinds or types of sound generators or transductors with same or similar beneficial effects in headphone performance, and that can have different shapes. For example, planar magnetic drivers, electrostatic speakers, drivers or speakers with piezoelectric elements, and ribbon speakers or drivers. Sound generators or transductors can have drive surfaces that have circular, rectangular, or other-shaped boundaries, and in example embodiments, acoustic transformers can have corresponding shapes or boundaries or effective surfaces that match or correspond to those of the sound generators or transductors to which they are paired.

CONCLUSION

Although the subject matter has been described in language specific to structural features and/or method or process acts, it is to be understood that the subject matter defined in the claims is not limited to the specific features or acts described above. Embodiments, methods and features described herein are disclosed as examples that can variously implement the claims.

What is claimed is:

1. A headphone, comprising:

an ear cup;

an acoustic transformer;

a driver between an inner surface of the ear cup and the acoustic transformer, wherein the acoustic transformer consists of first and second regions that are opposite each other, the first region including at least two apertures and the second region having a single aperture, the single aperture in the second region having an area that is greater than a combined area of all apertures in the first region.

2. The headphone of claim 1, wherein the apertures in the first region are adapted to pass higher frequencies than the single aperture in the second region.

3. The headphone of claim 1, wherein a boundary of the single aperture closest to a center of the acoustic transformer includes regular indentations.

4. The headphone of claim 1, wherein the ear cup is configured to fit in an orientation with respect to a listener's ear and when in the orientation, the acoustic transformer is aligned within the ear cup and with respect to the listener's ear so that an axis separating the first and second regions generally aligns with a vertical axis of the listener's head.

5. The headphone of claim 4, wherein the single aperture is aligned with a rear section of the listener's outer ear when the ear cup is in the orientation with the listener's ear.

6. The headphone of claim 5, wherein the at least two apertures are located opposite a forward section of the listener's pinna when the ear cup is in the orientation with the listener's ear, and wherein the first and second regions are semicircles.

7. The headphone of claim 1, wherein:

an inner edge of the single aperture is formed by a boundary of the acoustic transformer; and an outer edge of the single aperture is formed by an outer edge of the driver.

8. The headphone of claim 1, wherein the acoustic transformer is located at a distance between 1 and 3 millimeters from an acoustic driving surface of the driver.

9. A headphone, comprising:

an ear cup;

an acoustic transformer;

a driver between an inner surface of the ear cup and the acoustic transformer, wherein the acoustic transformer comprises a first section including at least two apertures and a second section including a single aperture, wherein the second section is opposite the first section and each of the at least two apertures has an area that is less than 30% of an area of the single aperture;

wherein the first and second sections form opposite halves of the acoustic transformer; and wherein the single aperture in the second section is larger than all other apertures in the acoustic transformer.

10. The headphone of claim 9, wherein the driver comprises an electromagnetic coil and the at least two apertures are arranged opposite an outer boundary of the electromagnetic coil.

11. The headphone of claim 9, wherein at least one of the at least two apertures has at least three straight sides, and one of the sides is closer to a center of the acoustic transformer than a vertex of the at least one aperture that is opposite the one side.

12. The headphone of claim 9, wherein the at least two apertures differ in shape.

13. The headphone of claim 9, wherein the at least two apertures differ in size.

14. The headphone of claim 9, wherein the at least two apertures are closer to a center of the acoustic transformer than the single aperture.

15. The headphone of claim 9, wherein:

the ear cup is configured to fit in an orientation with respect to a listener's ear so that when the ear cup is in the orientation, the acoustic transformer is aligned within the ear cup and with respect to the listener's ear so that an axis separating the first and second regions generally aligns with an ear centerline of the listener's ear;

the single aperture is aligned with a rear section of the listener's outer ear; and the at least two apertures are located opposite a forward section of the listener's outer ear.

16. The headphone of claim 15, wherein:

the axis separating the first and second regions is within 10 degrees of the ear centerline; and at least one of the at least two apertures includes an acoustic filtering element.

17. The headphone of claim 16, wherein the acoustic filtering element comprises a material different from that used in a body of the acoustic transformer.

18. The headphone of claim 15, wherein when the ear cup is in the orientation, one of the at least two apertures is located overlapping an ear canal opening of the listener.

19. A headphone, comprising:

an ear cup;

an acoustic transformer;

a driver between an inner surface of the ear cup and the acoustic transformer, wherein the acoustic transformer comprises a first region with at least two aperture sections and a single aperture section in a second region of the acoustic transformer that is opposite the first region, the single aperture section in the second region having greater area than a combined area of all aperture sections in the first region, and wherein at least two of the aperture sections in the acoustic transformer are joined by a slot that provides additional area for higher frequency sound to pass through the acoustic transformer.

20. The headphone of claim 19, wherein the slot extends between the at least two aperture sections in the first region, and the at least two aperture sections in the first region and the portion of the slot extending between them overlay an outer perimeter of a voice coil in the driver.

* * * * *